US005953839A

United States Patent [19]

Meeks

[11] Patent Number: 5,953,839

[45] Date of Patent: Sep. 21, 1999

[54] EXCAVATING ATTACHMENT FOR EARTH MOVING EQUIPMENT

[76] Inventor: J. Kelly Meeks, 538 Pleasant Hill Rd., Decatur, Ala. 35603

[21] Appl. No.: 08/934,618

[22] Filed: Sep. 22, 1997

[51] Int. Cl.[6] ..... E02F 3/96

[52] U.S. Cl. ..... 37/404; 37/442; 37/444; 172/253; 172/247

[58] Field of Search ..... 37/403–410, 468, 37/443, 444, 442; 414/912, 723; 172/295, 247, 250, 253, 254

[56] References Cited

U.S. PATENT DOCUMENTS

| | | | |
|---|---|---|---|
| 3,048,292 | 8/1962 | Kohorst et al. | 37/444 X |
| 3,460,691 | 8/1969 | Wieger et al. | 37/403 X |
| 4,411,583 | 10/1983 | Petitto, Sr. et al. | 37/407 X |
| 4,581,833 | 4/1986 | Zeravica | 37/444 |
| 5,020,249 | 6/1991 | Matthews | 37/444 |
| 5,628,130 | 5/1997 | Desrochers | 37/444 |
| 5,701,693 | 12/1997 | Brocious et al. | 37/407 X |

FOREIGN PATENT DOCUMENTS

| | | | |
|---|---|---|---|
| 150154 | 7/1985 | European Pat. Off. | 37/410 |

*Primary Examiner*—Victor Batson
*Attorney, Agent, or Firm*—Waddey & Patterson, P.C.

[57] ABSTRACT

An excavating attachment for conventional earth moving equipment that is capable of moving a shovel in generally horizontal, linear, non-arcuate, paths to dig and remove soil and other material from underneath a structure such as a series of pipes leading to a chemical facility. The excavating attachment comprises a frame including structure for securing same onto the free end of the longitudinally extending boom of conventional earth moving equipment, flexible hoses for connection to the power plant of the conventional earth moving equipment, a pair of parallel hollow, tubes; a shovel member including a pair of parallel, steel tubes, for reciprocating movement within the hollow tubes of the frame, and a shovel or scoop; and hydraulic cylinders secured to the frame and the shovel member and in communication with the flexible hoses for reciprocating the shovel member relative to the frame in linear, non-arcuate paths.

15 Claims, 3 Drawing Sheets

EXCAVATING ATTACHMENT FOR EARTH MOVING EQUIPMENT

FIELD OF THE INVENTION

This invention relates generally to an excavating attachment for earth moving equipment, and more particularly to a simple, durable, and efficient attachment adapted to be operated by the power plant of the earth moving equipment and to be controlled by the attendant of the earth moving equipment for removing contaminated material, earth or soil from underneath a plurality of pipes (pipe alley) lying on the ground or slightly elevated thereover, primarily associated with a chemical facility.

BACKGROUND OF THE INVENTION

Conventional earth moving equipment has found widespread acceptance for diverse purposes within the construction and environment clean-up industries. These large pieces of equipment are generally classified as backhoes, trackhoes, bobcats, front end loaders, etc. depending on the configuration of the machine's hydraulic boom and the earth moving bucket attached thereto. The conventional earth moving bucket is primarily a digging apparatus that moves generally in an arc towards the earth moving equipment when digging and is not capable of moving in a forward, generally horizontal, linear, path, away from the earth moving equipment during the digging process.

In view of the size and geometry of the boom and its relationship to the body of the earth moving equipment, as well as the digging action achieved by the bucket attachment, the conventional bucket attachment has proven incapable of digging underneath a structure such as a plurality of pipes (pipe alley) lying on the ground, or elevated slightly therefrom, to remove material, soil or earth, particularly contaminated material, soil or earth, from underneath a structure such as a pipe alley. Due to this deficiency in conventional earth moving equipment, the task of removing material or soil from underneath a structure such as a pipe alley has been accomplished by the use of manual laborers with shovels for prolonged periods of time. Thus, in view of the environmental concerns throughout the world, there is a need for a simple attachment for earth moving equipment which is capable of quickly and easily removing contaminated material or soil from underneath pipe alleys primarily associated with chemical facilities.

SUMMARY OF THE INVENTION

With the operational deficiencies of conventional earth moving equipment clearly in mind, the present invention is directed to a simple, durable and efficient attachment to conventional earth moving equipment adapted to be operated by the power plant of the earth moving equipment and controlled by the attendant of the earth moving equipment for removing contaminated soil or material from beneath a plurality of pipes (pipe alley). The attachment of the present invention is easily secured to the free end of the longitudinally extending boom of a trackhoe, backhoe or other similar earth moving equipment in lieu of the conventional bucket to enable successful digging operations of the trackhoe, backhoe or the like in previously inaccessible areas such as under pipe alleys, or under homes, foundations or the like.

The excavating attachment of the present invention comprises a frame member including means for securing same onto the free end of the longitudinally extending boom of conventional earth moving equipment, flexible hoses for connection to the power plant of the conventional earth moving equipment, a pair of parallel hollow, tubes; a shovel member including a pair of parallel, steel tubes, for reciprocating movement within the hollow tubes of the frame member, and a shovel or scoop; and hydraulic cylinder means secured to the frame member and the shovel member and in communication with the flexible hoses for moving the shovel member relative to the frame member in a generally horizontal, linear, non-arcuate path.

When the digging operation with the excavation attachment of the present invention is completed, the excavating attachment is disconnected from the boom of the earth moving equipment and the conventional bucket may be secured thereto to enable the earth moving equipment to be used in its normal manner. The relatively inexpensive attachment of the present invention enhances the operating capability of earth moving equipment, and enables the cleaning up of the environment.

It is therefore an object of the present invention to provide a simple, durable, attachment to conventional earth moving equipment for removing soil or material from underneath a structure.

It is a further object of the invention to provide a simple, durable, attachment for a trackhoe (or backhoe) adapted to be operated by the power plant of the trackhoe (or backhoe) for efficiently removing soil or material from underneath a structure such as a pipe alley.

It is still a further object of the present invention to provide a relatively simple, inexpensive, durable attachment for a conventional trackhoe (or backhoe) adapted to be operated by the power plant of the trackhoe (or backhoe) for efficiently removing contaminated soil or material from underneath a pipe alley associated with a chemical facility.

These and other objects and advantages of the present invention will become more apparent from the following detailed description when taken in conjunction with the accompanying drawings, specification and claims.

DETAILED DESCRIPTION OF THE INVENTION

Figure 1:
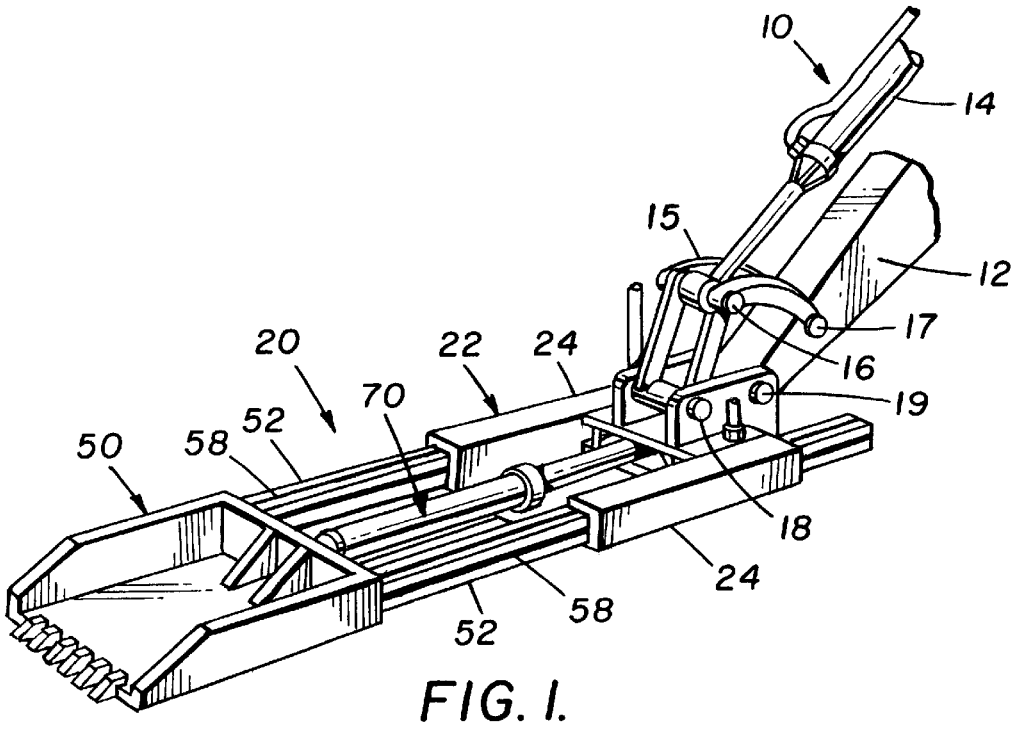
FIG. 1 is a fragmentary perspective view of a portion of a trackhoe (or backhoe) equipped with the excavating attachment embodying the novel features of the present invention with its scoop or shovel being in a position almost fully extended.

Referring now to the drawings, FIG. 1 depicts a portion of a conventional articulated boom 10 pivotally attached to a conventional earth moving equipment such as a trackhoe or backhoe. As shown, boom 10 includes an elongated arm 12, a hydraulic actuator 14 and generally inverted V-shaped linkage mechanisms 15 for removably securing the articulated boom 10 to the excavating attachment 20 which constitutes the present invention.

As best shown in FIGS. 1–5, excavating attachment 20 generally comprises a steel frame member 22, a shovel member 50, hydraulic cylinder means 70, and first and second flexible hydraulic lines 80 and 82 connected between hydraulic cylinder means 70 and the conventional power plant (not shown) of the earth moving equipment.

Figure 2:
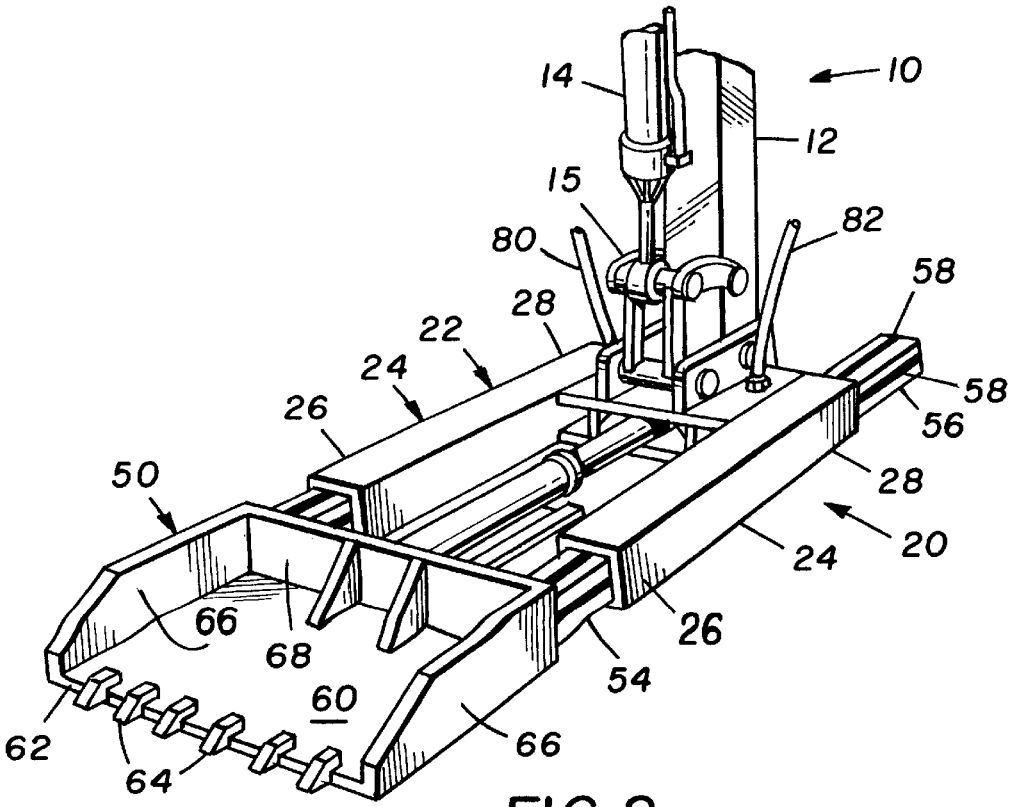
FIG. 2 is a fragmentary perspective view of the excavating attachment of the present invention secured to the main arm or boom of a trackhoe (or backhoe) with its scoop or shovel being in a position almost fully retracted.
Figure 3:
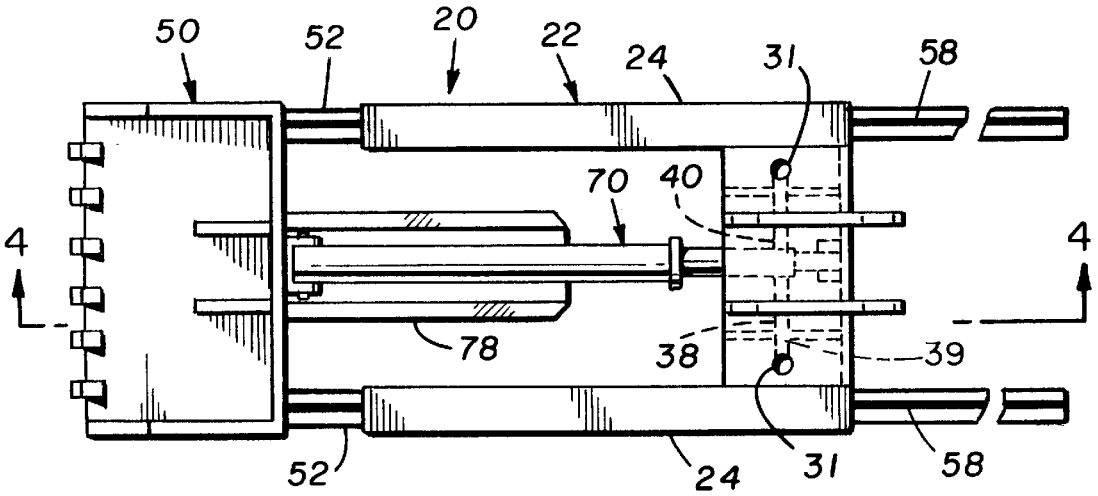
FIG. 3 is a top plan view of the excavating attachment of the present invention with its scoop or shovel being in a position almost fully retracted.
Figure 4:
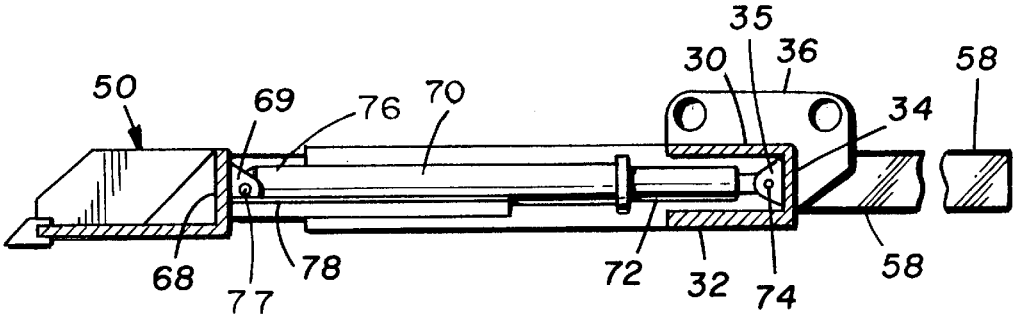
FIG. 4 is a sectional view of the excavating attachment of the present invention taken along line 4—4 of FIG. 3.
Figure 5:
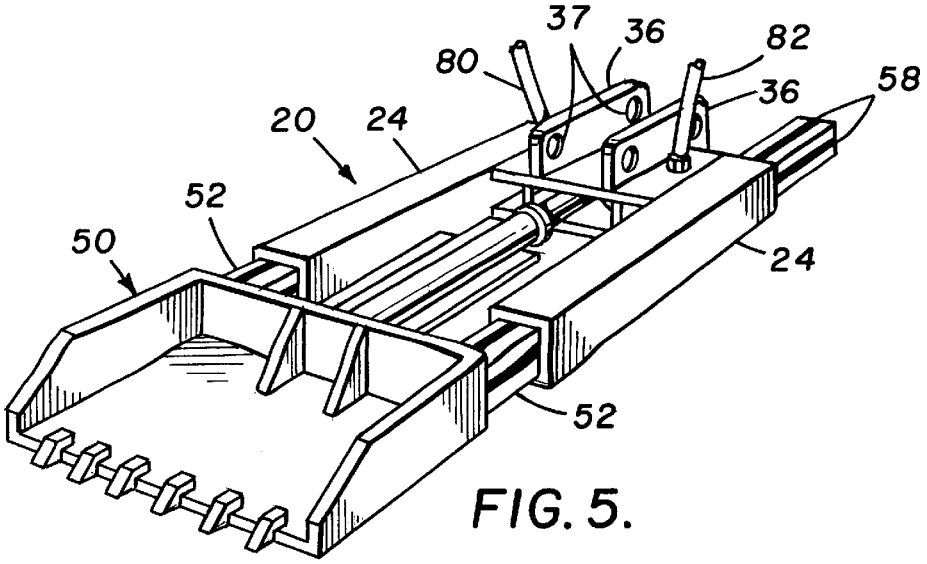
FIG. 5 is a perspective view of the excavating attachment of the present invention showing the scoop or shovel in its almost fully retracted position.
Figure 6:
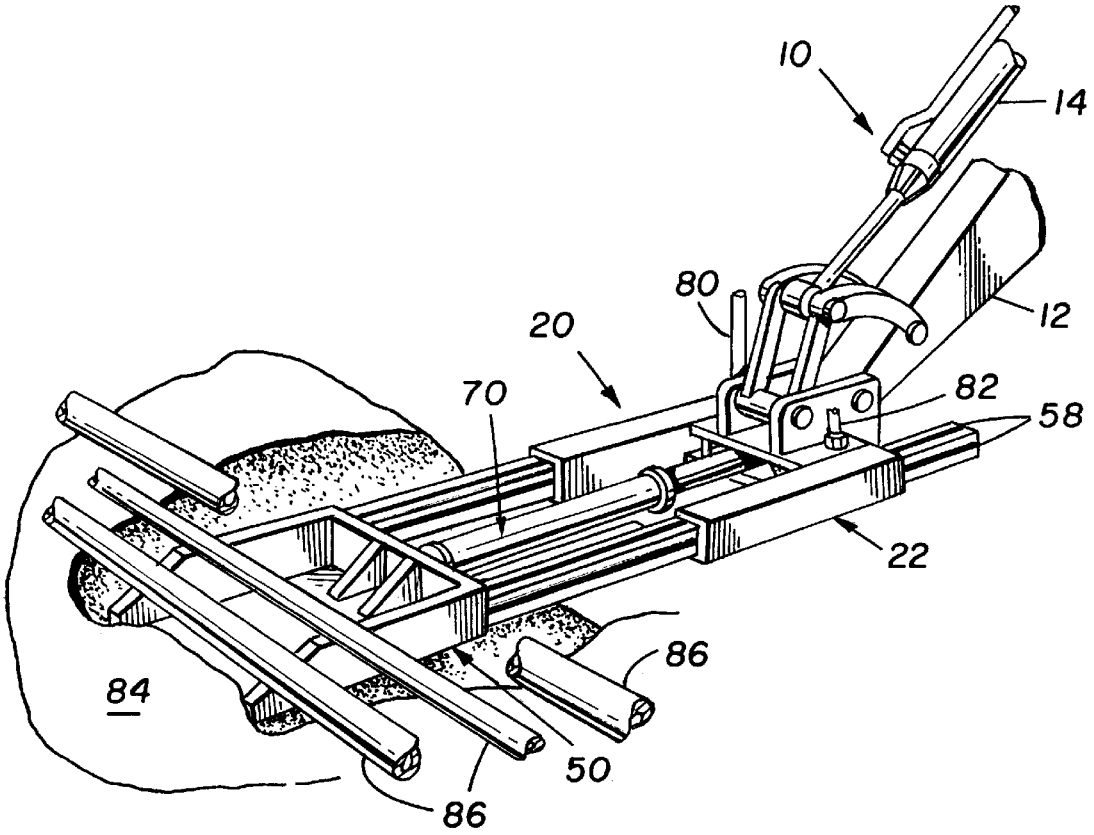
FIG. 6 is a perspective view of the excavating attachment of the present invention in its almost fully extended position digging into contaminated soil or material beneath a pipe line.

Frame member 22 includes a pair of hollow, parallel, elongated steel tubes 24, each having a first end portion 26 and a second end portion 28 (FIG. 2), three steel plates 30, 32 and 34 (FIG. 4) welded to second end portions 28 of steel tubes 24, a pair of upstanding, steel, plates 36 (FIGS. 4 and 5) welded to the upper surface of steel plate 30 and to outside surface of plate 34, and two hollow pipes 38 and 40 (FIG. 3), each having a first end (unnumbered) and a second end (unnumbered). As best shown in FIGS. 1, 4 and 5, each upstanding steel plate 36 has a pair of openings 37 for receiving pins 18 and 19 for respectively pivotally connecting a first end (not numbered) of generally inverted V-shaped bracket means 15 to the excavating attachment 20 and a second end (not numbered) of linkage mechanisms 15 to the free end of elongated arm 12 of the articulated boom 10 of the earth moving equipment. As best shown in FIGS. 1 and 2, the generally inverted V-shaped linkage mechanisms 15 includes openings (not numbered) for respectively receiving pins 16 and 17 for pivotally connecting linkage mechanisms 15 to the free end (not numbered) of hydraulic mechanism 14 and the free end of elongated arm 12 of the articulated boom 10 of the excavating attachment. The generally inverted V-shaped linkage mechanisms 15 and the manner of its pivotal connections to a digging unit such as excavating attachment 20 and the articulated boom 10 is conventional for most earth moving equipment. As best shown in FIGS. 3–5, the steel plate 30 includes a pair of openings 31 for allowing a connection between hollow pipe 40 with flexible hydraulic line 80 and hollow pipe 38 with flexible hydraulic line 82, which flexible hydraulic lines 80 and 82 are in communication with the power plant of the earth moving equipment. The shovel member 50 includes a pair of hollow, parallel, elongated, steel tubes 52, each having a first end portion 54 and a second end portion 56, a wear plate 58 secured to the upper and lower surface (unnumbered) of each elongated, steel tube 52, a shovel or scoop 60 having an open end 62 with a plurality of teeth 64, a pair of side walls 66, and a rear wall 68 welded to the first end portion 54 of each elongated, steel, tube 52. As best seen in FIG. 4, hydraulic cylinder means 70 includes a first end portion 72 pivotally secured by a pin 74 to a bracket 35 welded to the inner surface (not numbered) of steel plate 34 of frame member 22, a second end portion 76 pivotally secured by a pin 77 to a bracket 69 welded to one surface (not numbered) of rear wall 68 of shovel or scoop 60. As best seen in FIGS. 3 and 4, a steel member 78 is provided to assist in the support of the hydraulic cylinder means 70 with one end (not numbered) of steel support member 78 being welded to one surface of rear wall 68 of shovel or scoop 60 and its other end (not numbered) being welded to the bottom surface (not numbered) of hydraulic cylinder means 70. The hydraulic cylinder means 70 can be of almost any conventional type. It has been found that a double acting telescopic hydraulic cylinder having Model No. DAT 63-182-132 manufactured and distributed by Custom Hoists, Inc., P.O. Box 98, Hayesville, Ohio 44538 is suitable for use in an environment requiring operating pressure not exceeding 2500 P.S.I. This cylinder is of the push-pull type with hydraulic fluid being introduced to the hydraulic cylinder means 70 by way of flexible hydraulic line 80 and pipe 40 and being removed from hydraulic cylinder means 70 by way of flexible hydraulic line 82 and pipe 39. Where the required operating pressure might exceed 2500 P.S.I., a double acting telescopic hydraulic cylinder providing greater operating pressure could be selected for use in the attachment of the present invention. As shown in FIG. 6, reference numeral 84 designates contaminated soil with reference numeral 86 designating a plurality of pipes which represents a pipe alley.

In operation of the invention, the conventional bucket (not shown) is disconnected from the generally inverted V-shaped linkage mechanisms 15 connected to the boom 10 by removing the pins 18 and 19, after which the excavating attachment 20 is secured to the linkage mechanism 20 by reinserting the pins 18 and 19 through the appropriate openings (not numbered) in the ends of the generally inverted V-shaped linkage mechanisms 15 and the openings 37 in steel plate 36 of frame member 22. This operation secures excavating attachment 20 to the articulated boom 10 of the earth moving equipment. Once the excavating attachment 20 is secured to the articulated boom 10 of the earth moving equipment, the operator of the earth moving equipment will move the earth moving equipment with the shovel member 50 being in a generally fully retracted position, to a location adjacent to, and generally perpendicular, to the structure (e.g. a series of pipes 86) to begin the digging and removing of dirt or other material from beneath the structure.

The operator will then cause the introduction of hydraulic fluid through the first hydraulic line 80 and the pipe 40 in communication with the power plant of the earth moving equipment to cause the hydraulic cylinder means 70 to move the shovel member 50 in a generally horizontal, linear, path under the structure to dig soil or other material from beneath the structure. Once the shovel member 50 has been moved forward to its fully extended position, the operator of the earth moving equipment actuates the power plant of the earth moving equipment to expel hydraulic fluid from the hydraulic cylinder means 70 through pipe 38 and hydraulic line 82 which retracts shovel member 50 and its load to its fully retracted position, at which time the operator actuates the power plant of the earth moving equipment to cause the articulated boom 10 to lift the shovel member 50 to empty the soil or other material in the bed of a truck or elsewhere. These actions will continue repeatedly until an adequate amount of soil or other material has been removed from beneath the structure.

When the digging operation with the excavation attachment of the present invention is completed, the excavating attachment 20 is disconnected from the boom of the earth moving equipment and the conventional bucket may be secured thereto to enable the earth moving equipment to be used in its normal manner.

While the foregoing description of a preferred embodiment of the invention has been set forth with particular reference to a trackhoe or backhoe and its boom, the excavating attachment 20 is equally applicable to other earth moving equipment that employ a boom. Furthermore, cylinder means 70 need not be hydraulically operated, but may be electrically or pneumatically operated. Still furthermore, other linkage mechanisms may be utilized on the boom of the earth moving equipment. Still furthermore, the several components of the attachment, particularly components of the frame member 22 and the shovel member 50 could be made of material other than steel such as a polymer plastic and the configuration of the tubes 24 and pipes 52 could be round in lieu of rectangular, or in the configuration of I-Beams. Thus, it is to be understood that the present invention is not limited to the embodiment described in the specification and drawings, but encompasses any and all embodiments within the scope of the following claims.

I claim:

1. An excavating attachment adapted to be secured to power driven linkages located upon a boom of earth moving equipment for digging and removing material from underneath a structure, said excavating attachment comprising:

a frame including a plurality of hollow, parallel, steel, tubes, each said tube having first and second end portions, means extending between said second end portions of said hollow, parallel, steel tubes for securing said second end portions;

a shovel member including a plurality of parallel, steel, components, each having first and second ends and being telescoped within a respective said hollow steel tube of said frame, and a shovel secured to said first ends of each said steel component;

hydraulic cylinder means secured to said frame and said shovel member and in communication with the power plant of the earth moving equipment for causing reciprocating movement between said shovel member and said frame, said reciprocating movement being in a linear, non-arcuate path; and fastener means for securing said attachment in an operative relationship to said boom of the earth moving equipment.

2. The excavating attachment of claim 1 wherein said means for securing said second ends of said steel tubes of said frame includes a plurality of steel plates.

3. The excavating attachment of claim 1 wherein said shovel of said shovel member includes a rear wall, a bottom wall, a pair of side walls and an open end bearing a plurality of teeth for aiding in the digging action to remove the material, said teeth extending from said bottom wall and in substantially planar relation therewith.

4. The excavating attachment of claim 1 wherein said hydraulic cylinder means includes at least one piston rod.

5. The excavating attachment of claim 1 further including a pair of hydraulic lines in communication with said hydraulic cylinder means.

6. The excavating attachment of claim 1 wherein said fastener means includes linkage means and a plurality of pins for connecting said attachment to the earth moving equipment.

7. The excavating attachment of claim 1 wherein said means for securing together said second end portions of said steel tubes of said frame includes a plurality of steel plates and wherein said shovel of said shovel member includes a rear wall, a bottom wall, a pair of side walls and an open end having a plurality of teeth secured thereto for aiding in the digging for the removal of the material.

8. The excavating attachment of claim 7 wherein said steel tubes and said steel components are rectangular in configuration.

9. The excavating attachment of claim 8 further including a plurality of wear plates secured to each of said rectangular steel components.

10. An excavating attachment adapted to be pivotally joined to an articulated boom of earth moving equipment, for digging and removing material from underneath a structure, said excavating attachment comprising:

a frame including a plurality of hollow, parallel, steel tubes, each said tube having first and second end portions, a plurality of steel plates extending between said second end portions of said steel tubes securing said second end portions, and a bracket secured to one of said steel plates;

a shovel member including a plurality of parallel, steel, elements, each having a first end, a shovel having a pair of side walls, and a rear wall which is secured to said first end of each said steel element, and a bracket secured to said rear wall of said shovel, said steel elements being mounted telescopically within a respective said hollow, steel, tube of said frame;

hydraulic cylinder means having a first end secured to said bracket of said frame and a second end secured to said bracket of said shovel member for causing said shovel member to reciprocate in a linear, non-arcuate path relative to said frame; and fastener means for removably securing said attachment in operative relationship to said articulated boom of the earth moving equipment.

11. The excavating attachment of claim 10 wherein said shovel of said shovel member further includes an open end bearing a plurality of teeth for aiding in the digging action to remove the material.

12. The excavating attachment of claim 10 wherein said hydraulic cylinder means includes at least one piston rod.

13. The excavating attachment of claim 10 further including a pair of hydraulic lines in communication with said hydraulic cylinder means and a plurality of wear plates secured to each of said steel tubes.

14. The excavating attachment of claim 10 wherein said fastener means includes linkage and a plurality of pins for connecting said attachment to said earth moving equipment.

15. The excavating attachment of claim 14 wherein said steel tubes and said steel tubes are rectangular in configuration.

* * * * *